US008418507B2

(12) United States Patent
Beckler et al.

(10) Patent No.: US 8,418,507 B2
(45) Date of Patent: Apr. 16, 2013

(54) METHOD FOR CIRCULAR-KNITTING OF A SOCK

(75) Inventors: Mitchell Coleman Beckler, Niota, TN (US); Robert Hoyt Yoe, Niota, TN (US)

(73) Assignee: Yoe Enterprises of Nevada, Inc., Chattanooga, TN (US)

( * ) Notice: Subject to any disclaimer, the term of this patent is extended or adjusted under 35 U.S.C. 154(b) by 0 days.

(21) Appl. No.: 13/551,099

(22) Filed: Jul. 17, 2012

(65) Prior Publication Data

US 2013/0031937 A1 Feb. 7, 2013

Related U.S. Application Data

(60) Provisional application No. 61/513,968, filed on Aug. 1, 2011.

(51) Int. Cl.
*D04B 9/46* (2006.01)

(52) U.S. Cl.
USPC ..... 66/187

(58) Field of Classification Search ..... 66/183, 66/178 R, 184, 185, 186, 187, 30, 32, 39
See application file for complete search history.

(56) References Cited

U.S. PATENT DOCUMENTS

| | | | | | |
|---|---|---|---|---|---|
| 2,590,008 | A | * | 3/1952 | Grothey et al. | 66/187 |
| 2,608,847 | A | * | 9/1952 | Torgersen | 66/187 |
| 3,028,739 | A | * | 4/1962 | Marlette et al. | 66/187 |
| 3,054,279 | A | * | 9/1962 | Crawford | 66/48 |
| 3,650,126 | A | * | 3/1972 | Luchi | 66/48 |
| 3,785,173 | A | * | 1/1974 | Hanney et al. | 66/9 R |
| 4,561,266 | A | * | 12/1985 | Hacker | 66/51 |
| 4,644,762 | A | * | 2/1987 | Hacker | 66/51 |
| 5,170,646 | A | * | 12/1992 | Gariboldi | 66/51 |

* cited by examiner

*Primary Examiner* — Danny Worrell
(74) *Attorney, Agent, or Firm* — Muncy, Geissler, Olds & Lowe, PLLC

(57) ABSTRACT

A method of knitting a sock with a bulbous heel and a square toe is disclosed. A circular sock knitting machine is controlled in four phases to alternately narrow and widen the heel and toe by actuating only some of the needles in the knitting machine. The result is a sock with an expanded Y-gore and a heel and toe of increased size.

13 Claims, 15 Drawing Sheets

METHOD FOR CIRCULAR-KNITTING OF A SOCK

CROSS REFERENCE TO RELATED APPLICATIONS

The present application claims priority to U.S. provisional patent application Ser. No. 61/513,968, filed on Aug. 1, 2011, the subject matter of which is incorporated herein in its entirety.

BACKGROUND OF THE INVENTION

1. Field of the Invention

This invention relates generally to a method for knitting a sock and more particularly to a method for the circular knitting of a sock having a bulbous heel and a square toe.

2. Description of the Prior Art

Circular knitting sock machines are commercially available items and use a system of needles and yarn feeders to knit a single sock in a tubular shape. The needles are arranged in a circle and are actuated sequentially. Stitches will be sequentially added in a circle, and thus, rows of stitches are added to the cylinder or tube of the sock. Thus, when every needle in the circle has added a stitch, a full circle of stitches will have been added, forming a full circular row to the tube. If this continues, a tube is formed from the rows of stitches.

However, it is generally desired to provide additional shapes to the sock, such as angles and pockets, especially in the toe and heel so that the sock is more anatomically shaped. This has been accomplished by actuating only certain portions of the needles in the circle at a time. The needles that are actuated add a stitch, while those that are not actuated do not add stitches. Thus, partial rows are added only on the side of the sock that is actuated. For example, if a heel is being added, only the part of the circle that makes up the heel is actuated, so that rows are only added on that side, while the remainder of the sock remains the same length. This therefore places extra material in this portion of the sock and increases its area thereby forming a heel.

An anomaly in the stitching pattern occurs every time such a partial row is added. These odd-stitches create a line in the sock, known as a "gore". One standard gore occurs in a straight line and is typically located in the heel and toe of the sock. Since the machine knits only on one side of the sock, extra material is added on that side to create a bend in the sock forming a heel, for example. Another more complicated pattern occurs where a Y-shaped gore is formed to make a better shaped heel. This knitting method is known in the circular knitting machine art.

Similarly, a typical toe gore occurs in a straight line at the corners of the toe region of the sock. It is the means by which the knitting machine joins the corner material of the sock and "closes" its edges. The gore closure allows the sock toe to have a circular shape and not a "squared off" appearance. It also prevents excess material in the edges of the sock and thus, a more comfortable fit inside a shoe or boot.

A "Y" gore line in the toe provides additional room by giving an added dimension of depth to the toe closure of the sock. This allows the knitter to decrease the horizontal dimension of the toe of the sock (thereby minimizing excess material along the sock edges) while increasing the overall volume and array of toe shapes it can accommodate. This provides increased fit and security in the toe, preventing undesired movement of the toes within the sock. Also, unwanted movement between the sock and the foot (twisting, sliding, etc.) can be avoided.

Commercially available circular knitting machines are produced by a number of companies. One such machine is made by Sangiacomo. This machine contains 144 needles in a circle. Other models by this company or by different companies may have differing numbers of needles in the circle, but the concept of the formation of gores by reducing the number of actuated needles is the same.

Certain socks have been designed with exaggerated heel and toes shapes. US design application 29/382,385, filed Jan. 3, 2011 shows such an exaggerated sock heel. Likewise US design application 29/382,373, filed Jan. 3, 2011 shows such an exaggerated toe shape. In addition to the design attributes of the heel and toe, there are certain benefits that result from this exaggerated shape. For example, the bulbous shape of the heel causes it to cling more tightly to the heel, so that the sock is not dragged down into the shoe, especially during running or other kinds of exercise.

The exaggerated toe shape provides a targeted area to accommodate toe volume. FIG. 15A illustrates a typical toe box 100. Typically, socks accommodate volume with the width of the toe box. This creates unused space and causes the toe of the sock to twist and slip.

FIG. 15B illustrates an expanded or double toe box 110. The expanded toe box decreases the width of the sock toe and creates a focused region 112 at the very front of the sock that can expand, as necessary, to accommodate various toe volumes.

FIG. 16A illustrates a typical sock 102 having a typical gore 104, without a foot inserted into the sock. FIG. 16B illustrates the sock 102 with a foot inserted into the sock. As can be seen from FIG. 16B, in a sock with a typical toe box, the gore 104 moves with an increase in volume.

In contrast, in the expanded toe box, the gore does not move. That is, FIG. 16C illustrates a sock 114 having the expanded toe box 110. As is illustrated in FIG. 16D, when a foot is inserted into the sock 114 with the expanded toe box 110, the gore 116 stays in place. The excess volume is accommodated in the focused region 112.

In order to create this box, a "Y" gore 116 is placed on either side of the toe region. This gore is created like the heel by the engaging/disengaging of needles during the reciprocating motion of the circular knitting cylinder. Therefore, there is an increase in reciprocations when knitting the toe region, and thus an increase in machine run times. This method teaches away from conventional thinking.

Furthermore, these shapes are more complicated to form on the circular knitting machine and cannot be done using a simple known gore.

SUMMARY OF THE INVENTION

Accordingly, the present invention provides a method for the circular knitting of a sock.

The present invention further provides a method of circular knitting of a sock having a bulbous heel.

The present invention further provides a method of circular knitting of a sock having a square toe.

The present invention further provides a method of circular knitting of a sock having a bulbous heel and a square toe.

The present invention still further provides a method of knitting a sock using different phases with different numbers of actuated needles.

The present invention still further provides a method of knitting a sock with a bulbous heel using different phases with different numbers of actuated needles.

The present invention still further provides a method of knitting a sock with a square toe using different phases with different numbers of actuated needles.

The present invention still further provides a method of knitting a sock with a bulbous heel and a square toe using different phases with different numbers of actuated needles.

Briefly, this is achieved by providing plural phases during the knitting process, where in each phase, the number of actuated needles changes in a circular knitting machine, so that the number of stitches increases or decreases. The phases alternate increasing and decreasing the numbers of needles, causing widening or narrowing of the heel or toe in an alternate fashion. This will cause an expanded Y-gore and an increase in the size of the heel and toe.

BRIEF DESCRIPTION OF THE DRAWINGS

A more complete appreciation of the invention and many of the attendant advantages thereof will be more readily obtained as the same becomes better understood by reference to the following detailed description when considered in connection with the accompanying drawings, wherein.

DESCRIPTION OF THE PREFERRED EMBODIMENTS

Figure 1:
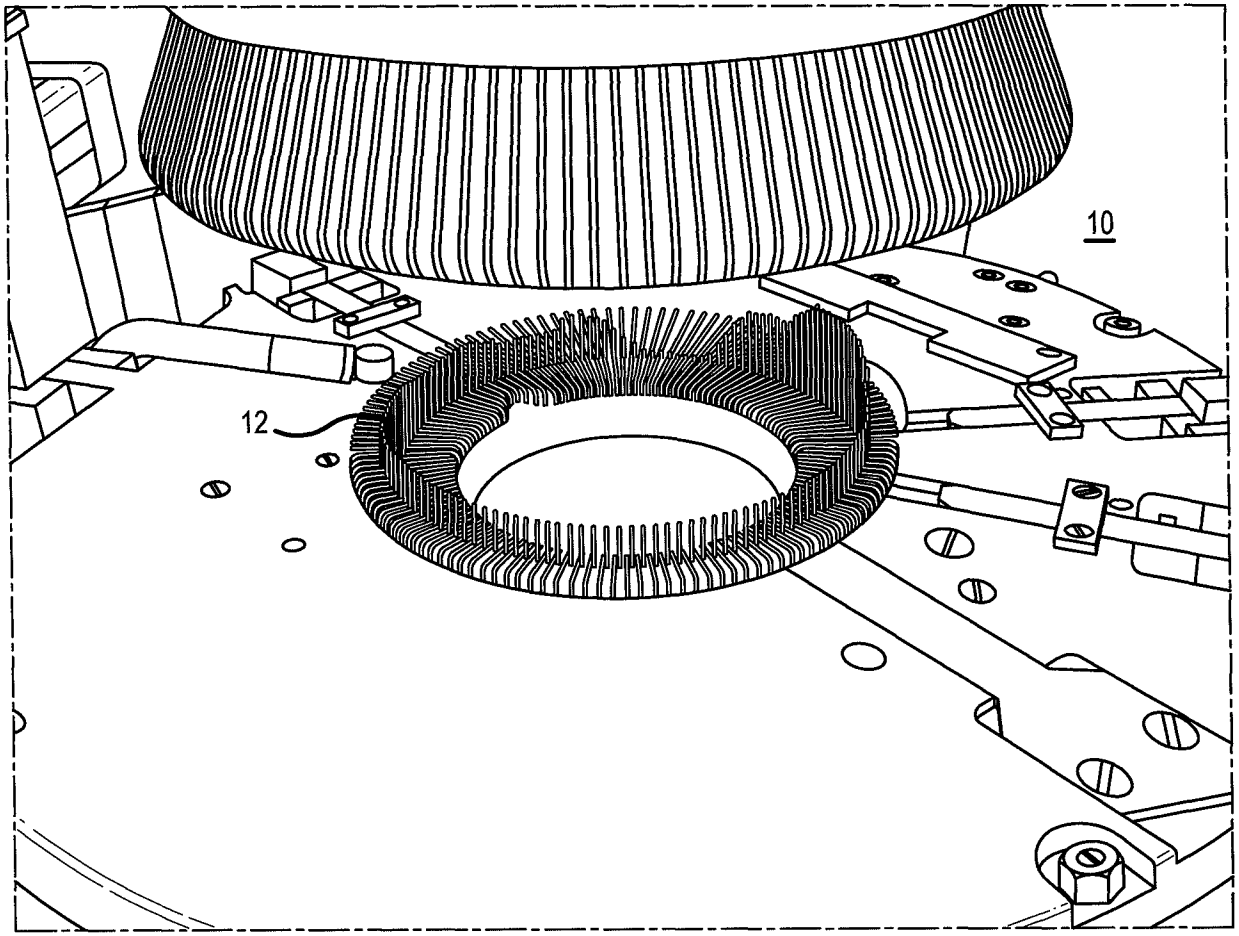
FIG. 1 is a perspective view of a known circular knitting sock machine.

Referring now to the drawings, wherein like reference numerals designate identical or corresponding parts throughout the several views, and more particularly to FIG. 1, a known circular sock knitting machine 10 is shown with 144 needles 12 in a circle. The needles are mounted in a knitting cylinder 14. Each needle is actuated in sequence to form a series of stitches in a circular row. If an incomplete row is desired, in order to change the circular shape to one which is more anatomically desirable, only some of the 144 needles are actuated.

Figure 2:
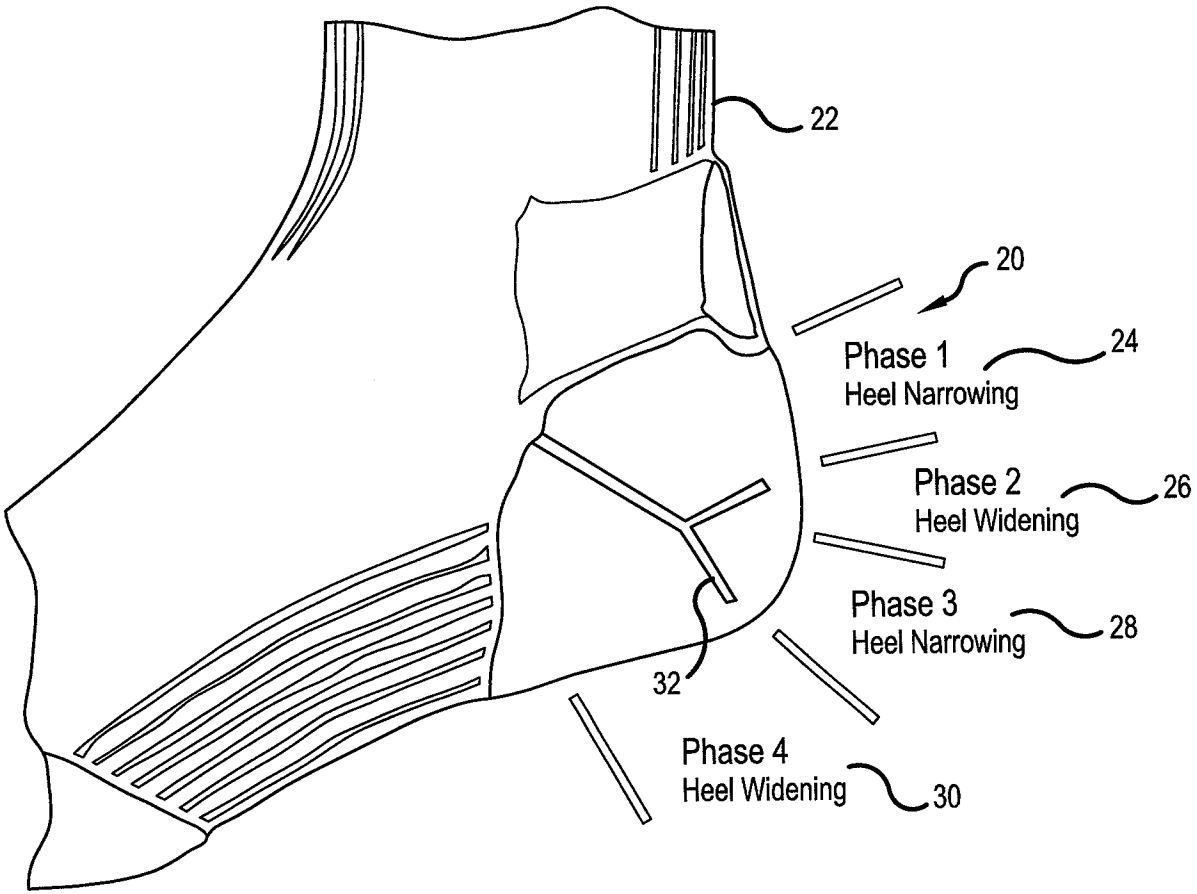
FIG. 2 is a diagram of the heel of a sock formed by the present invention and the phases used to form it.

FIG. 2 shows the formation of a heel 20 of a sock 22 with four phases 24, 26, 28 and 30 of knitting shown to obtain the desired shape. The phases alternately narrow and widen the heel to form a deeply expanded "Y" gore 32 with exaggerated lengths and shape points. This provides a shape with additional volume in the heel pocket.

Figure 3:
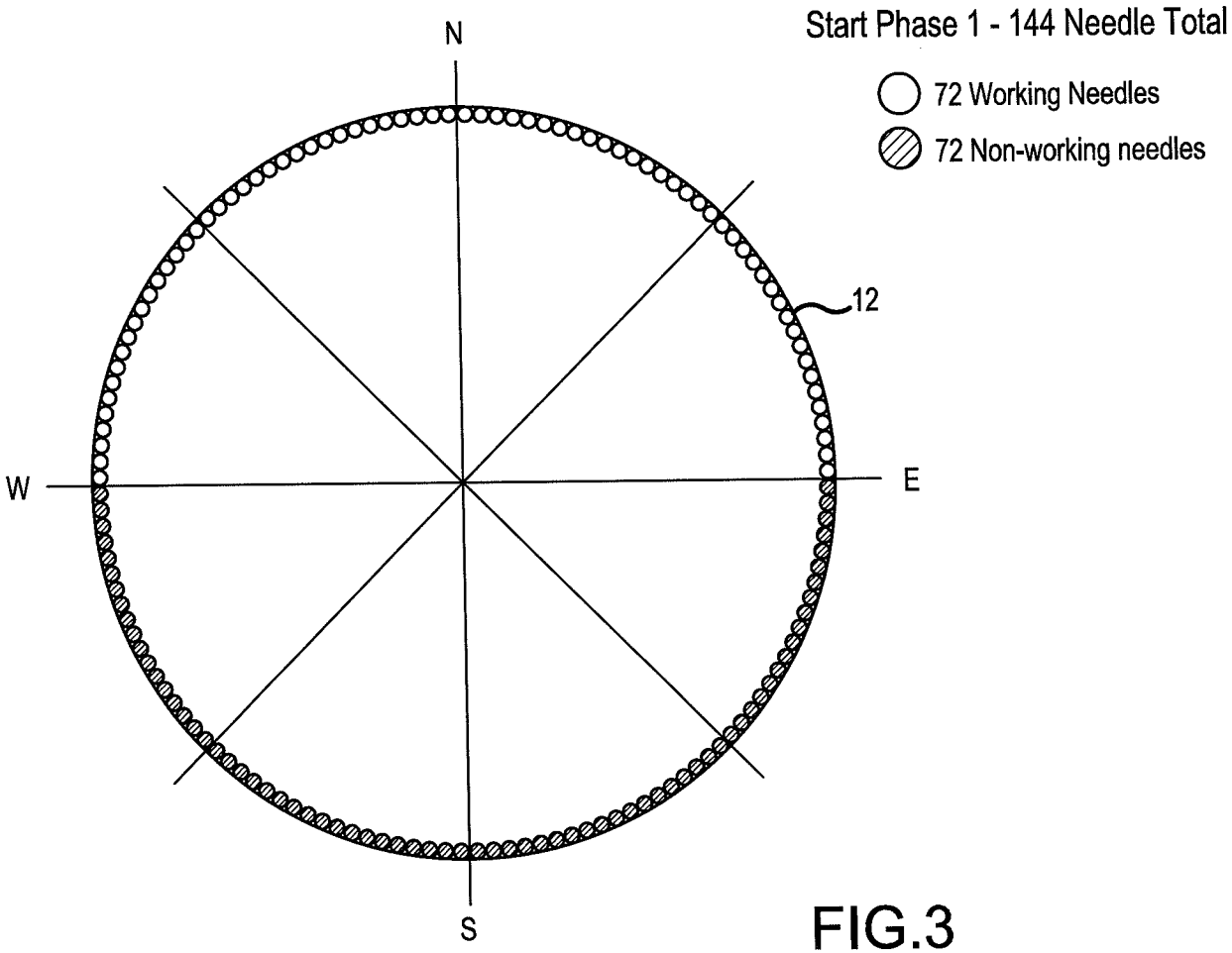
FIG. 3 is a diagram of the needles used at the beginning of phase 1 of the heel.

FIG. 3 is a diagram of the needles actuated at the beginning of phase 1. Thus, half (72) of the needles on the "north" half of the circle are actuated to knit. The result is a narrowing of the heel during this phase. While certain numbers of needles or stitches may be noted, it should be appreciated that the present invention is not limited to such numbers. The method of the invention is applicable to many different types of circular knitting machines.

It should be noted that the reference to "north" or any other direction in the knitting circle is not to be considered as limiting of the invention. Such nomenclature is used merely to provide a reference point for the preset description.

Phase 1 begins with 72 needles engaged and 72 needles disengaged. At this point, the knitting cylinder reciprocates from side to side. As the knitting cylinder reaches the end of one side of its motion, the outermost needle is disengaged. Then, the knitting cylinder changes direction, rotating to the other side. Once it reaches the end of this motion, the outermost needle (opposite the last disengaged needle) is then disengaged. Needles are disengaged until the working needle count reaches 26 needles.

Figure 4:
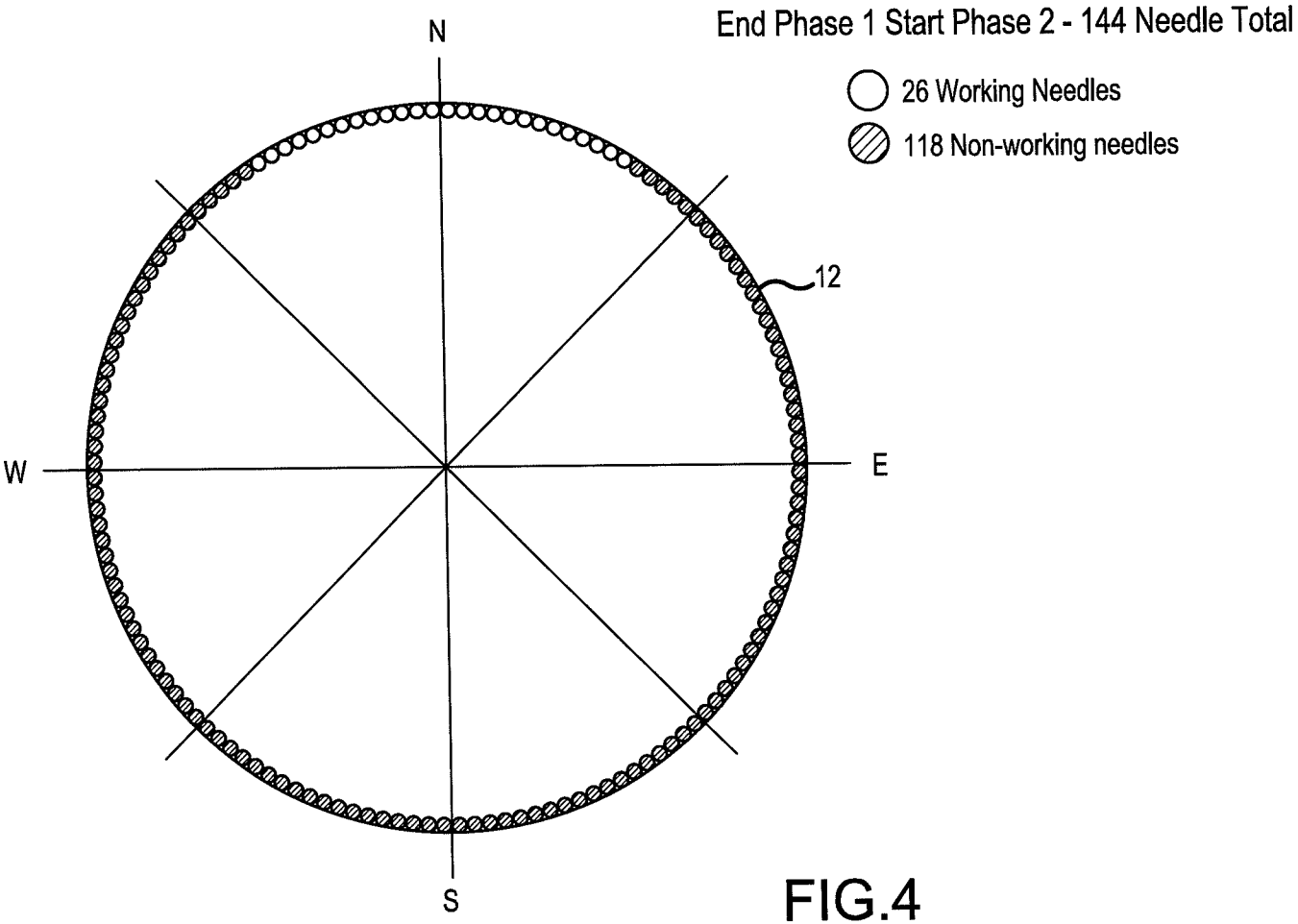
FIG. 4 is a diagram of the needles used at the beginning of phase 2 of the heel.

FIG. 4 is a diagram of the needles actuated at the beginning of phase 2. Thus, 26 of the needles centered on "north" are actuated to knit. The result is a widening of the heel during this phase.

Phase 2 begins with 118 needles disengaged and 26 needles engaged. From here the reciprocation begins, only this time re-engaging the working needles. The knitting cylinder reciprocates from side to side, re-engaging the outermost needle at the end of each swing. Phase 2 ends once the working needle count reaches 50 needles.

Figure 5:
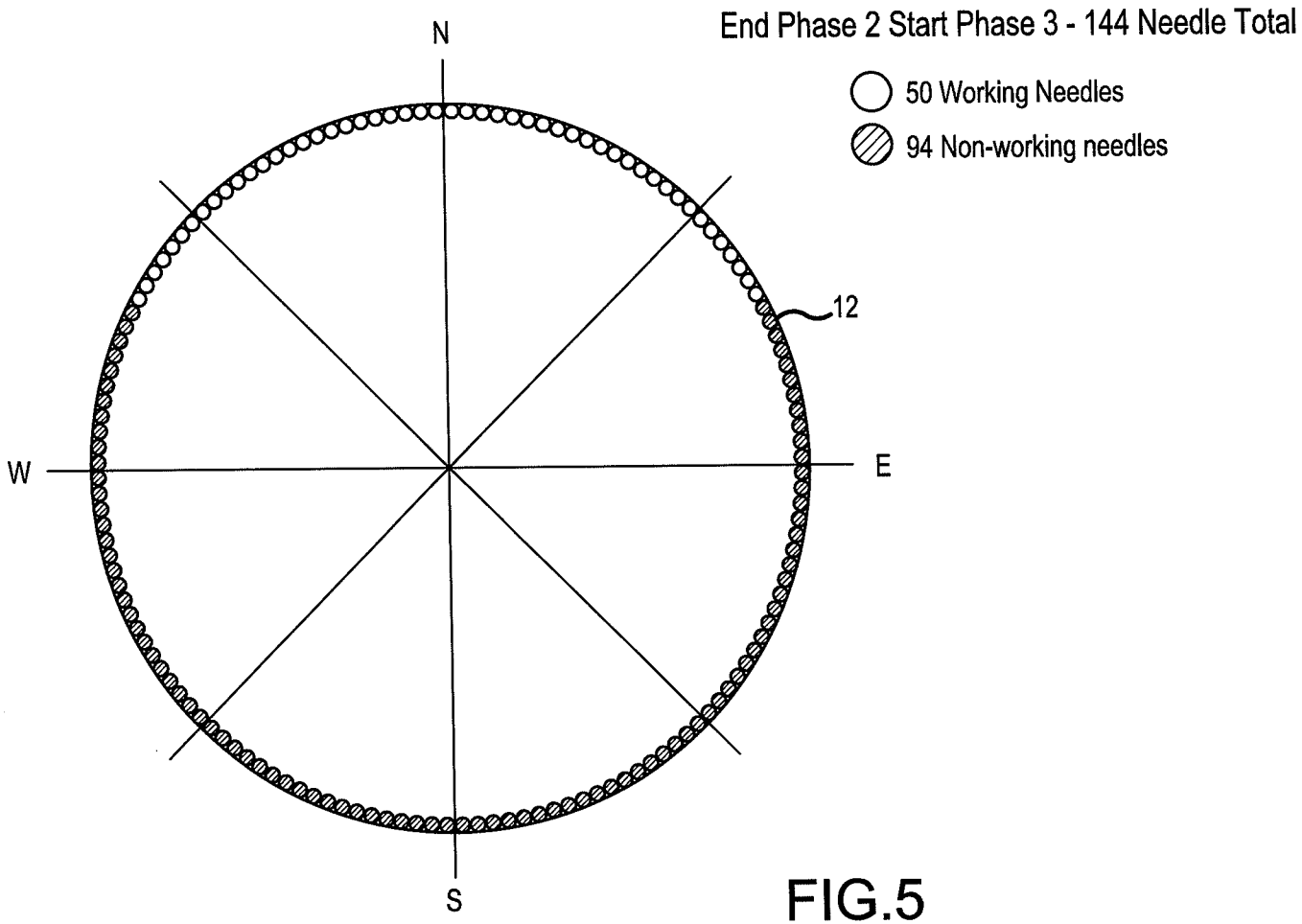
FIG. 5 is a diagram of the needles used at the beginning of phase 3 of the heel.

FIG. 5 is a diagram of the needles actuated at the beginning of phase 3. Thus, 50 of the needles centered on "north" are actuated to knit. The result is a narrowing of the heel during this phase.

Figure 6:
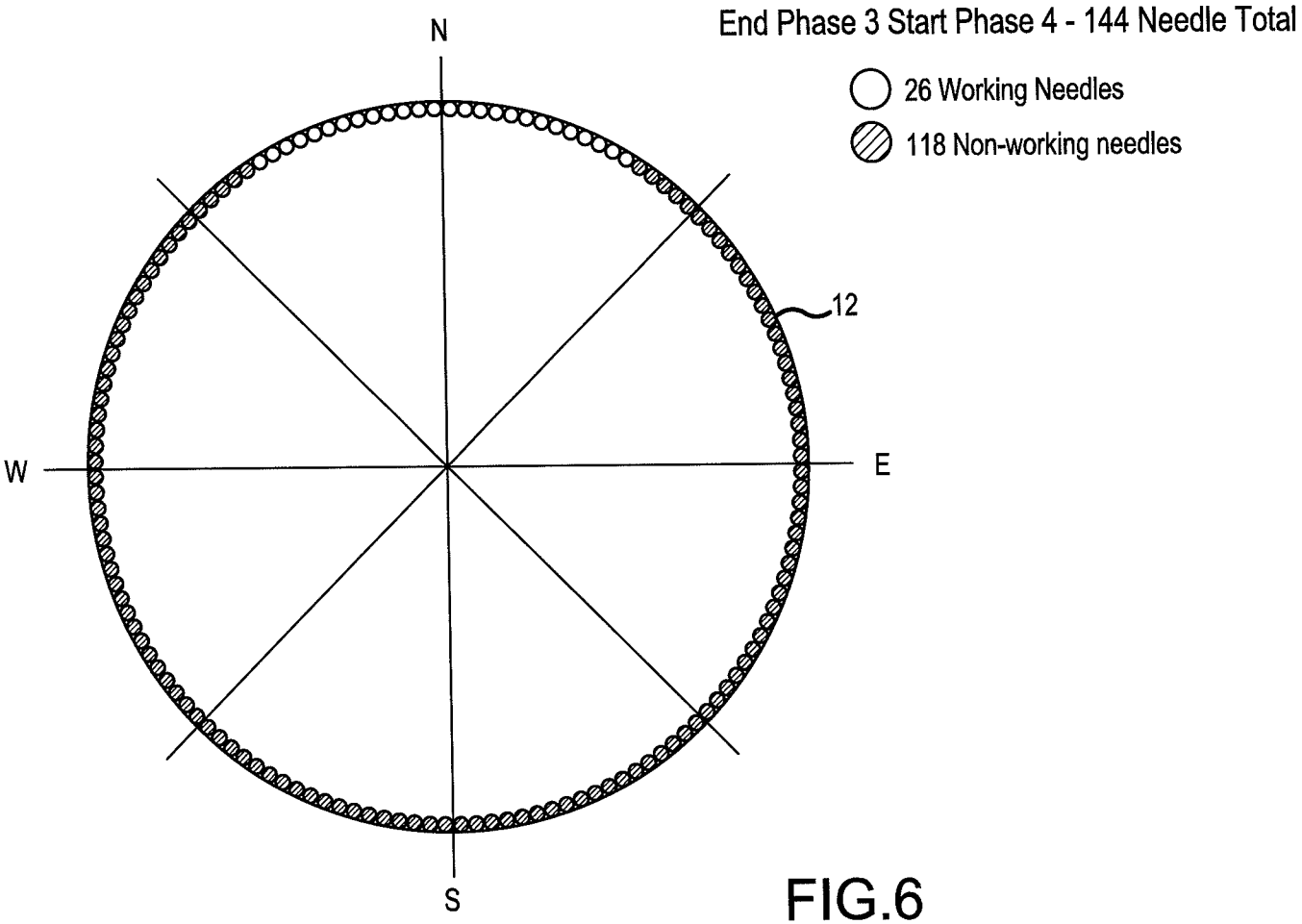
FIG. 6 is a diagram of the needles used at the beginning of phase 4 of the heel.
Figure 7:
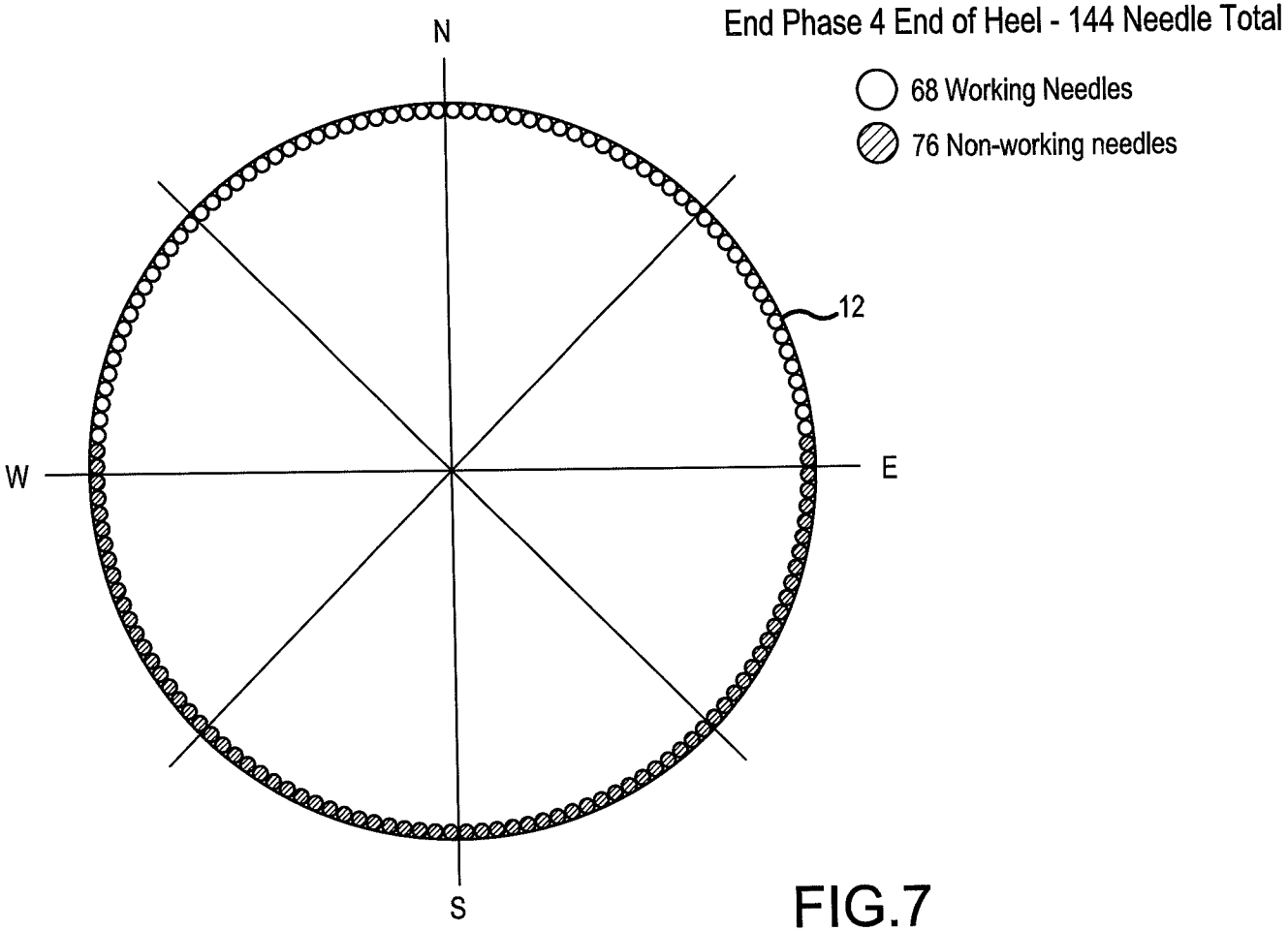
FIG. 7 is a diagram of the needles used at the end of phase 4 of the heel.

Phase 3 begins with 94 needles disengaged and 50 needles engaged. From here the reciprocation begins again. As in Phase 1, with each rotation of the knitting cylinder, working needles are once again disengaged. The knitting cylinder reciprocates from side to side, disengaging the outermost needle at the end of each swing. Phase 3 ends once the working needle count reaches 26 needles FIG. 6 is a diagram of the needles actuated at the beginning of phase 4. Thus, 26 of the needles centered on "north" are actuated to knit. The result is a widening of the heel during this phase. Phase 4 begins with 118 needles disengaged and 26 needles engaged. Once again, the reciprocation begins and the knitting cylinder begins re-engaging needles until the count reaches 68. Phase 4 ends once the working needle count reaches 68 needles FIG. 7 is a diagram of the needles actuated at the end of phase 4. Thus, 68 of the needles centered on "north" are actuated to knit.

Figure 8:
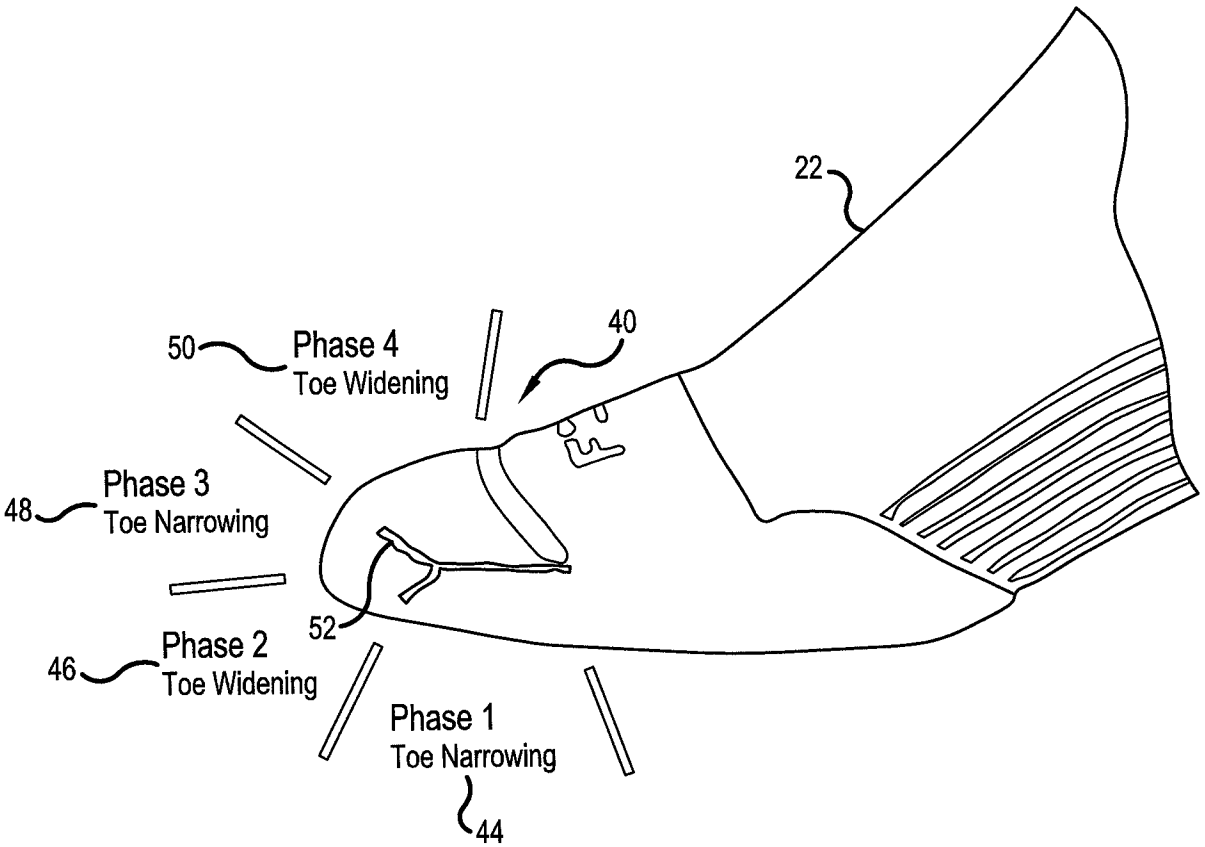
FIG. 8 is a diagram of the toe of a sock formed by the present invention and the phases used to form it.

FIG. 8 shows the formation of a toe 40 of a sock 22 with four phases 44, 46, 48 and 50 of knitting shown to obtain the desired shape. The phases alternately narrow and widen the toe to form a deeply expanded "Y" gore 52 with exaggerated lengths and shape points. This provides a shape with additional volume in the toe.

Figure 9:
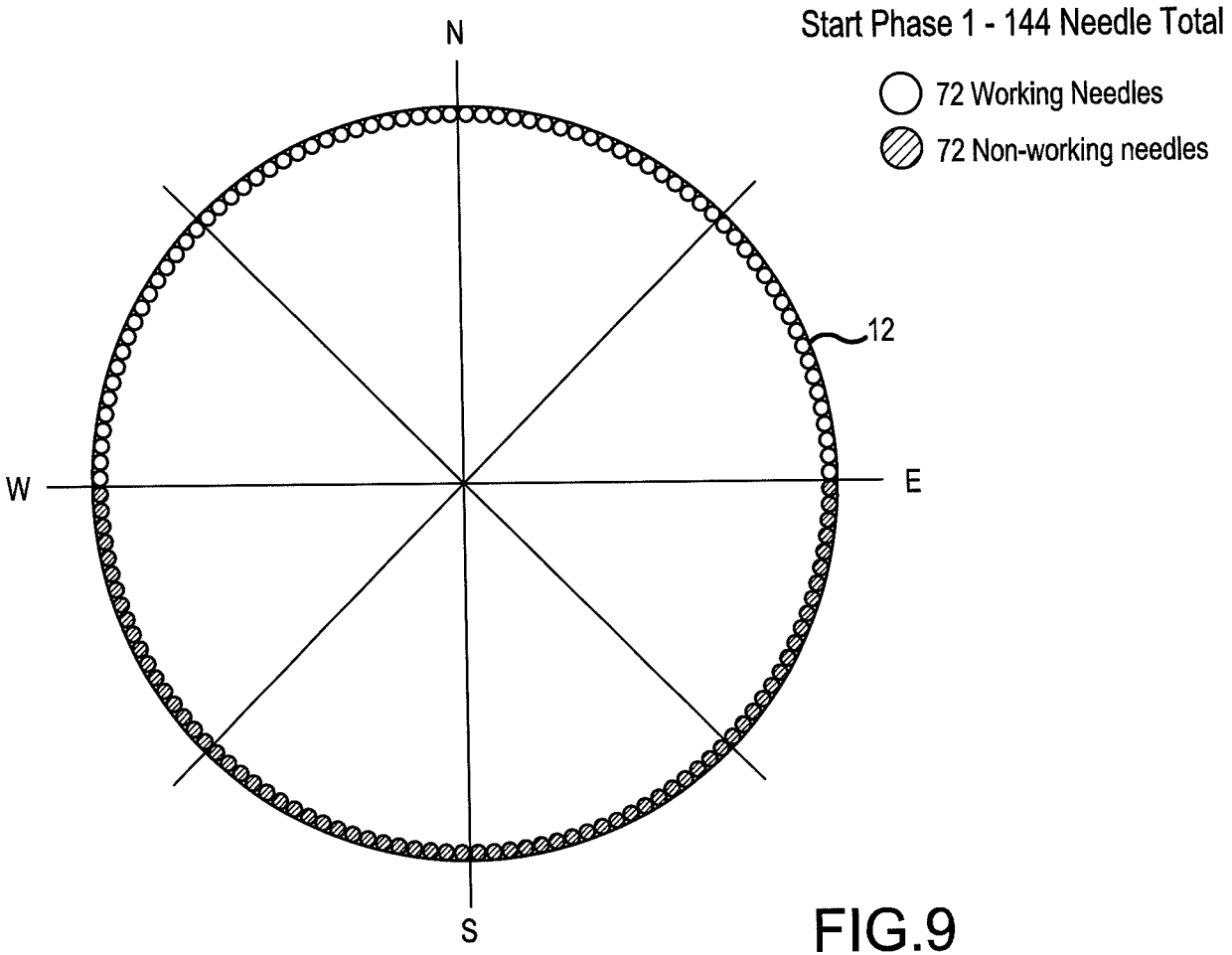
FIG. 9 is a diagram of the needles used at the beginning of phase 1 of the toe.

FIG. 9 is a diagram of the needles actuated at the beginning of phase 1. Thus, half (72) of the needles on the "north" half of the circle are actuated to knit. The result is a narrowing of the toe during this phase.

Phase 1 begins with 72 needles engaged and 72 needles disengaged. At this point, the cylinder head reciprocates from side to side. As the knitting cylinder reaches the end of one side of its motion, the outermost needle is disengaged. Then, the knitting cylinder changes direction, rotating to the other side. Once it reaches the end of this motion, the outermost needle (opposite the last disengaged needle) is then disengaged. Needles are disengaged until the working needle count reaches 24 needles.

Figure 10:
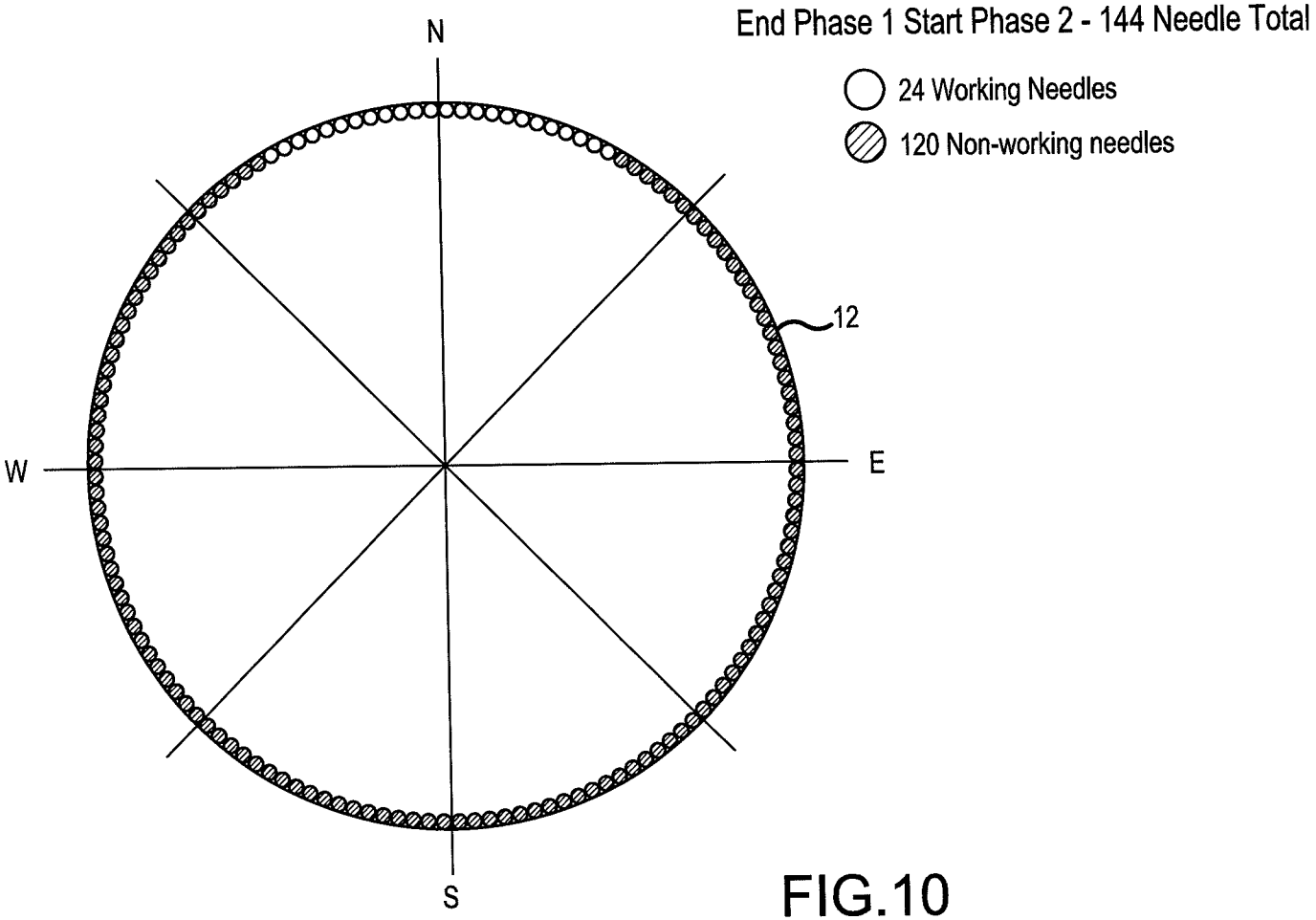
FIG. 10 is a diagram of the needles used at the beginning of phase 2 of the toe.

FIG. 10 is a diagram of the needles actuated at the beginning of phase 2. Thus, 24 of the needles centered on "north" are actuated to knit. The result is a widening of the toe during this phase.

Phase 2 begins with 120 needles disengaged and 24 needles engaged. From here the reciprocation begins, only this time re-engaging the working needles. The knitting cylinder reciprocates from side to side, re-engaging the outermost needle at the end of each swing. Phase 2 ends once the working needle count reaches 36 needles.

Figure 11:
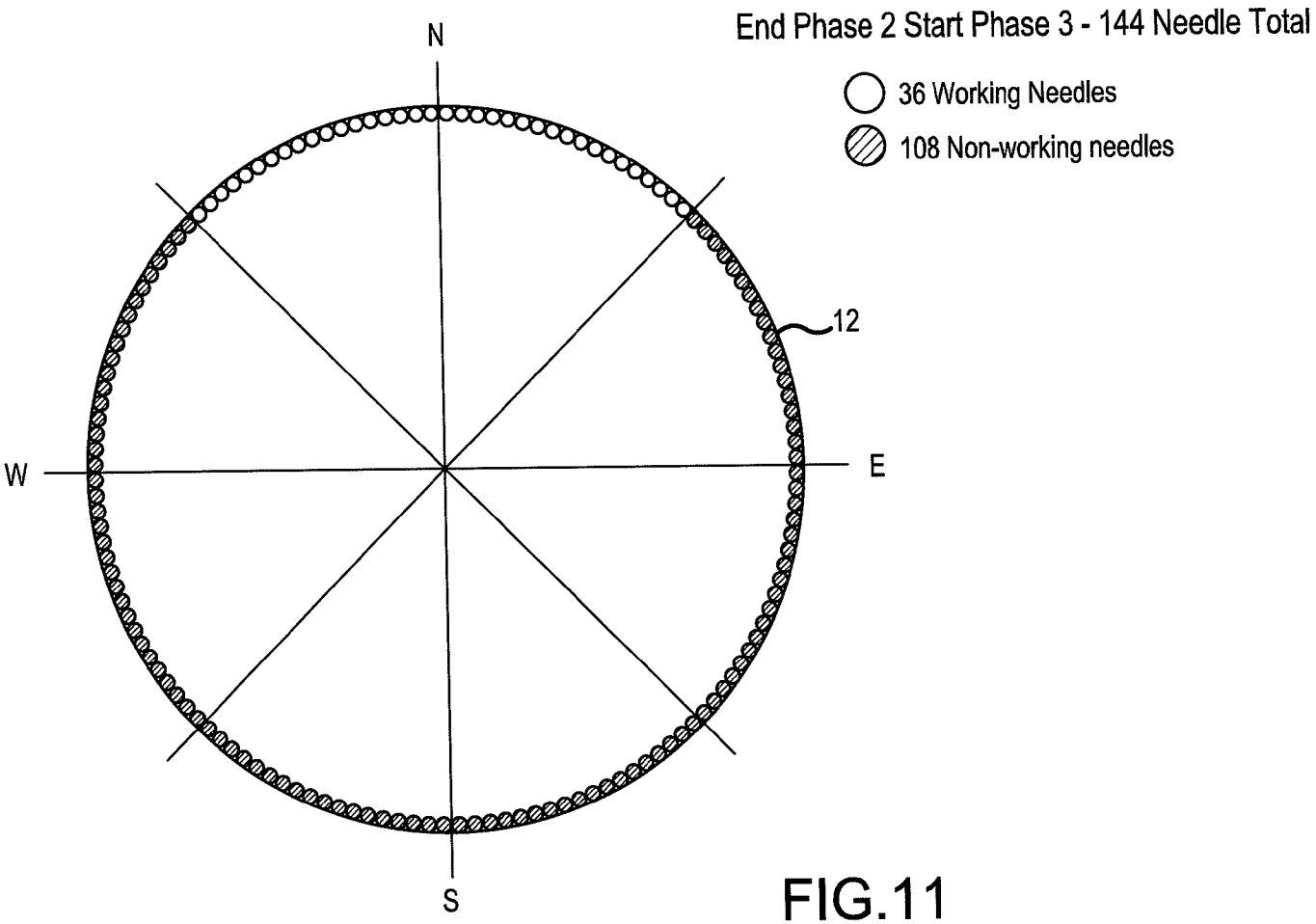
FIG. 11 is a diagram of the needles used at the beginning of phase 3 of the toe.

FIG. 11 is a diagram of the needles actuated at the beginning of phase 3. Thus, 36 of the needles centered on "north" are actuated to knit. The result is a narrowing of the toe during this phase.

Phase 3 begins with 108 needles disengaged and 36 needles engaged. From here the reciprocation begins again. As in Phase 1, with each rotation of the knitting cylinder, working needles are once again disengaged. The knitting cylinder reciprocates from side to side, disengaging the outermost needle at the end of each swing. Phase 3 ends once the working needle count reaches 24 needles.

Figure 12:
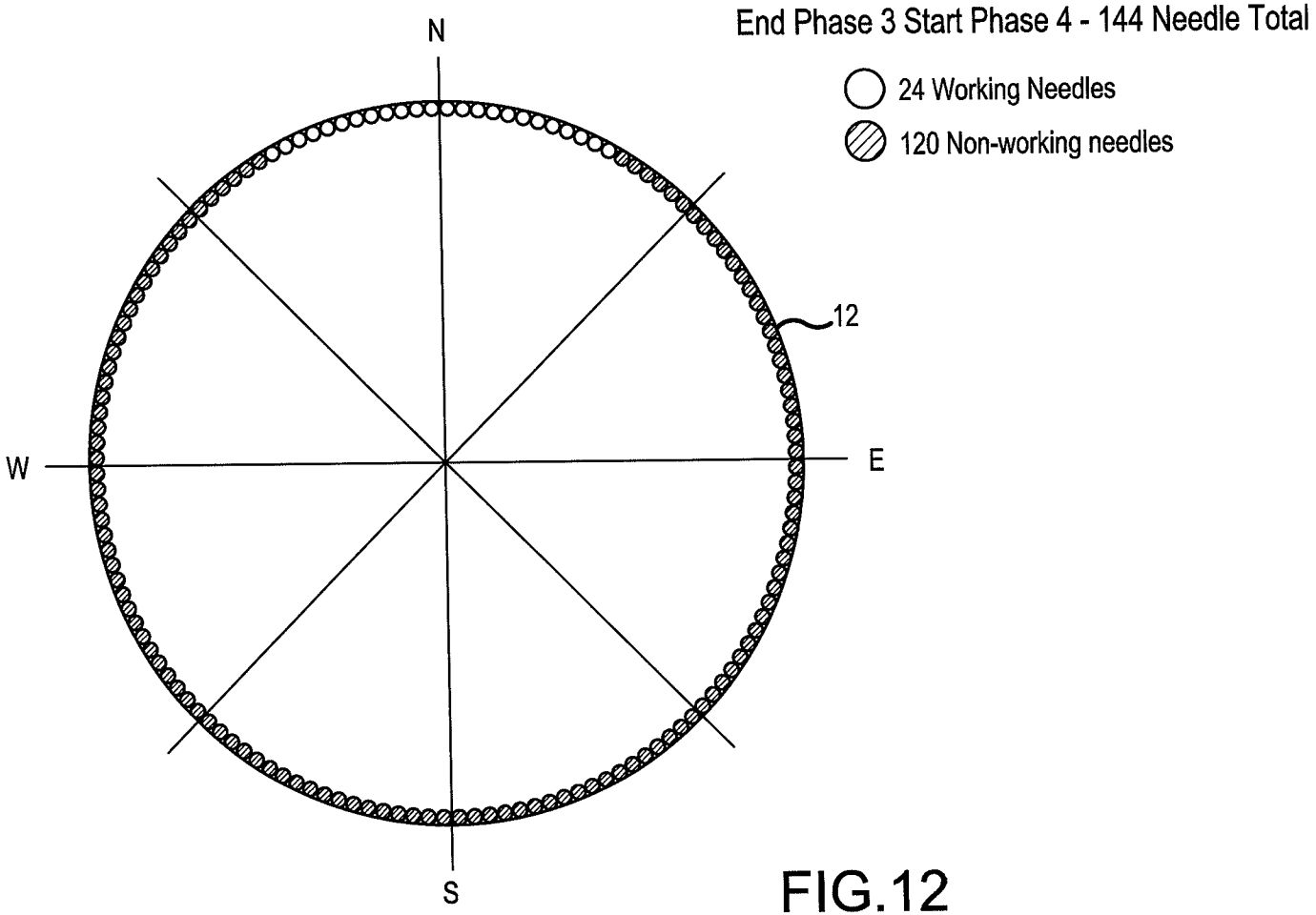
FIG. 12 is a diagram of the needles used at the beginning of phase 4 of the toe.

FIG. 12 is a diagram of the needles actuated at the beginning of phase 4. Thus, 24 of the needles centered on "north" are actuated to knit. The result is a widening of the toe during this phase.

Figure 13:
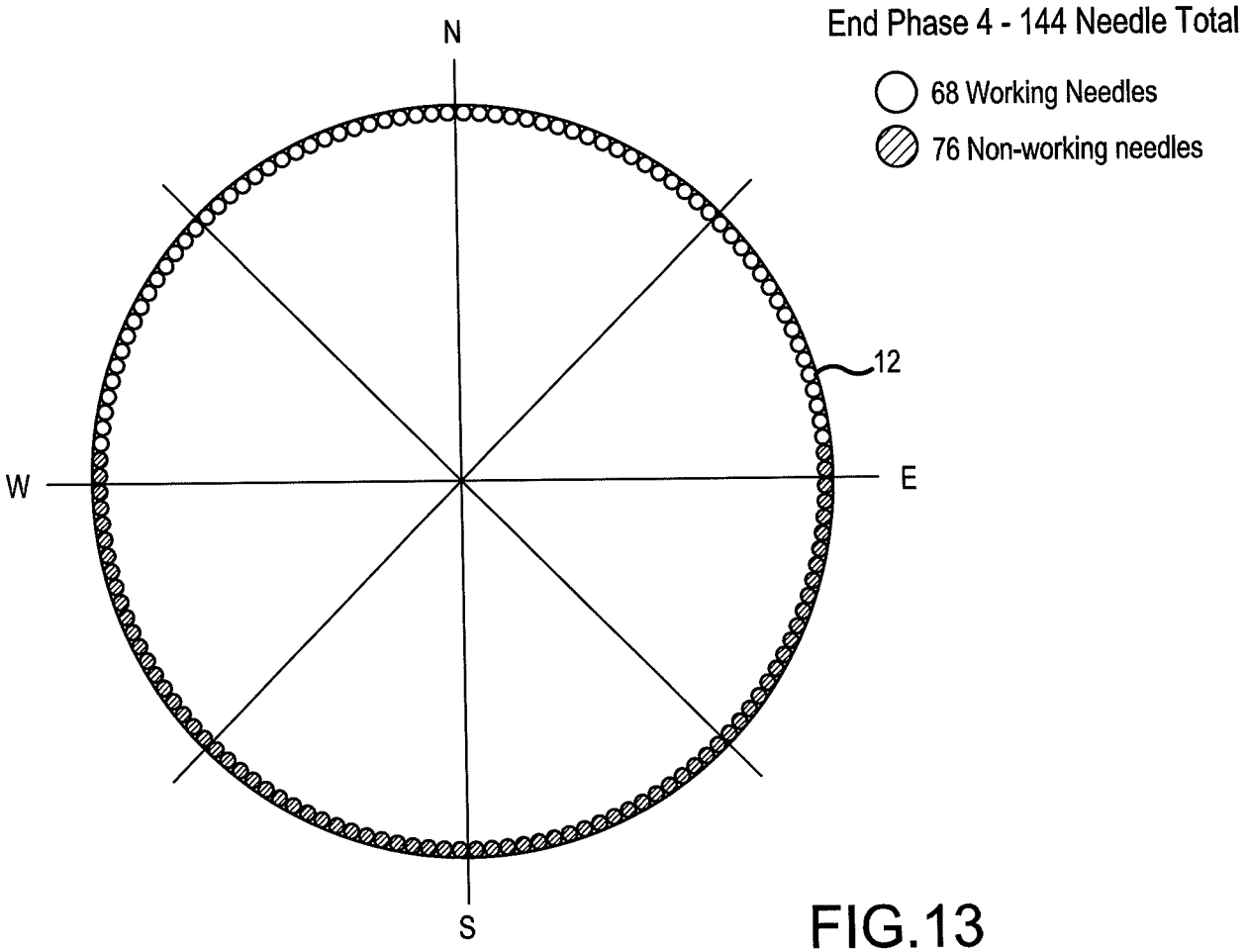
FIG. 13 is a diagram of the needles used at the end of phase 4 of the toe.

Phase 4 begins with 120 needles disengaged and 24 needles engaged. Once again, the reciprocation begins and the knitting cylinder begins re-engaging the needles until the count reaches 68. Phase 4 ends once the working needle count reaches 68 needles FIG. 13 is a diagram of the needles actuated at the end of phase 4. Thus, 68 of the needles centered on "north" are actuated to knit.

As will be appreciated from the above, when the sock is being knitted, the number of actuated needles is varied during the construction of the heel and toe sections to alternately narrow and widen the section. As a result, the shape of the heel and toe changes to form a bulbous heel and a square toe. This is accomplished by the formation of an expanded "Y" gore, which changes the shape of the heel and toe and produces the desired shape. As noted earlier, this shape provides certain advantages in preventing the heel from being dragged down into the shoe during exercise.

Figure 14:
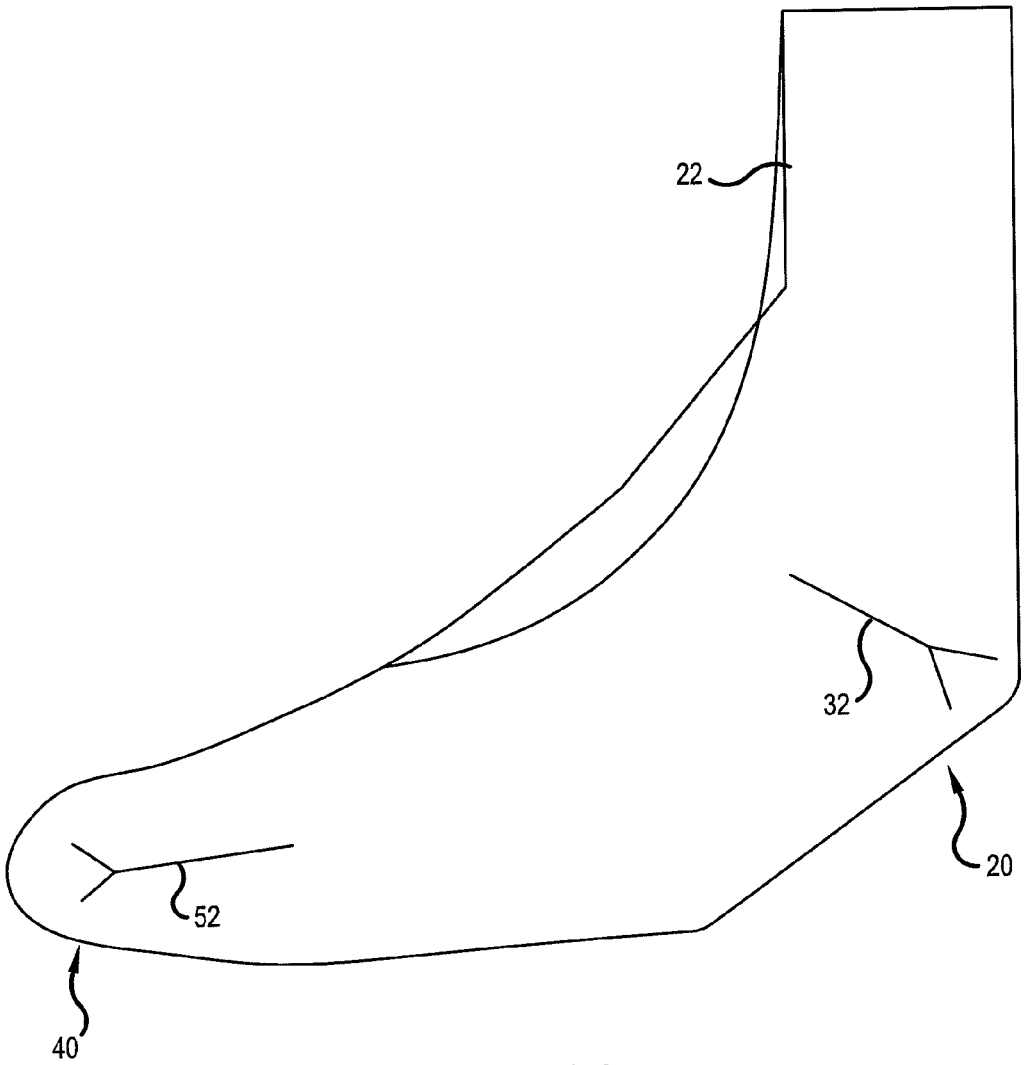
FIG. 14 is a diagram of the shape of the sock obtained by the present method.
Figure 15A:
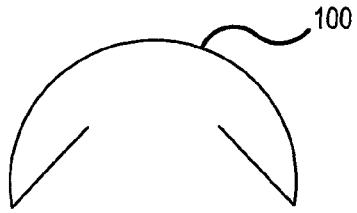
FIG. 15A illustrates a typical sock toe box.
Figure 15B:
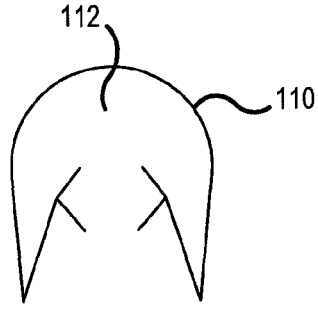
FIG. 15B illustrates an expanded sock toe box.
Figure 16A:
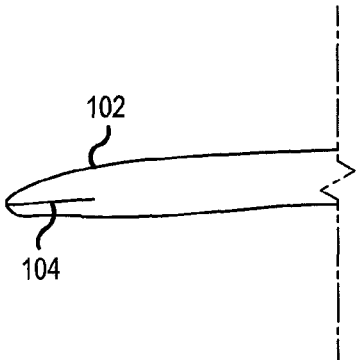
FIGS. 16A and 16B illustrate a sock having a typical gore.
Figure 16B:
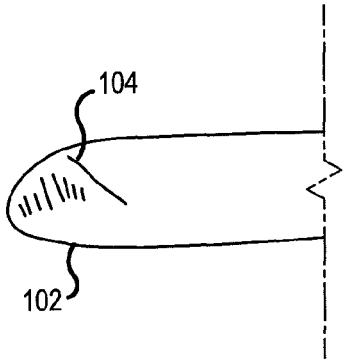
Figure 16C:
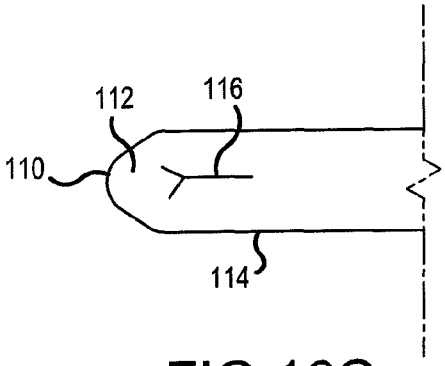
FIGS. 16C and 16D illustrate a sock having a "Y" gore.
Figure 16D:
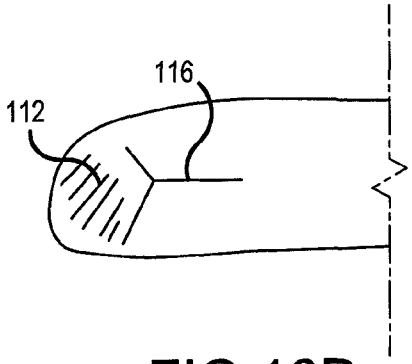

The specific shape of the heel and toe that is obtained is seen in FIG. 14. It will be noted that a bulbous heel and square toe box is formed for this uniquely shaped sock. This sock design will enable the sock to stay in position. While a crew length sock is shown in FIG. 14, this method is equally applicable to quarter length socks which end below the ankle bone when work. Even shorter socks can be manufactured by this method. Likewise, longer socks such as over-the-calf socks can be manufactured with this method.

Numerous additional modifications and variations of the present invention are possible in light of the above teachings. It is therefore to be understood that within the scope of the appended claims, the invention may be practiced otherwise than as specifically described herein.

The invention claimed is:

1. A method of knitting a sock using a circular knitting sock machine having a plurality of needles, comprising:

knitting part of the sock in a circular shape by actuating all of the needles;

knitting a heel of the sock in phases with the number of actuated needles in each phase being less than all of the needles; and forming a toe of the sock having a Y-shaped gore, said forming the toe comprising knitting the toe of the sock in phases with the number of actuated needles in each phase being less than all of the needles.

2. The method of knitting according to claim 1, wherein the heel is knitted in four phases, alternating between narrowing and widening the heel.

3. The method of knitting according to claim 2, wherein phase 1 narrows, phase 2 widens, phase 3 narrows and phase 4 widens.

4. The method of knitting according to claim 2, wherein the circular knitting sock machine has 144 needles and phase 1 actuates 72 needles, phase 2 actuates 26 needles, phase 3 actuates 50 needles and phase 4 actuates 26 needles.

5. The method of knitting according to claim 1, wherein the toe is knitted in four phases, alternating between narrowing and widening the toe.

6. The method of knitting according to claim 5, wherein phase 1 narrows, phase 2 widens, phase 3 narrows and phase 4 widens.

7. The method of knitting according to claim 5, wherein the circular knitting sock machine has 144 needles and phase 1 actuates 72 needles, phase 2 actuates 24 needles, phase 3 actuates 36 needles and phase 4 actuates 24 needles.

8. A method of knitting a bulbous heel on a sock, comprising:

forming said heel having a Y-shaped gore using a circular knitting sock machine having a plurality of needles, said forming said heel comprising:

knitting a first phase having a first reduced number of needles;

knitting a second phase having a second reduced number of needles;

knitting a third phase having a third reduced number of needles; and knitting a fourth phase having a fourth reduced number of needles.

9. The method of knitting according to claim 8, wherein said plurality of needles is 144, said first reduced number is 72, said second reduced number is 26, said third reduced number is 50 and said fourth reduced number is 26.

10. The method of knitting according to claim 8, wherein said first phase narrows the heel, the second phase widens the heel, the third phase narrows the heel and the fourth phase widens the heel.

11. A method of knitting a square toe on a sock, comprising:

forming said toe having a Y-shaped gore using a circular knitting sock machine having a plurality of needles, said forming said toe comprising:

knitting a first phase having a first reduced number of needles;

knitting a second phase having a second reduced number of needles;

knitting a third phase having a third reduced number of needles; and knitting a fourth phase having a fourth reduced number of needles.

12. The method of knitting according to claim 8, wherein said plurality of needles is 144, said first reduced number is 72, said second reduced number is 24, said third reduced number is 360 and said fourth reduced number is 24.

13. The method of knitting according to claim 8, wherein said first phase narrows the toe, the second phase widens the toe, the third phase narrows the toe and the fourth phase widens the toe.

* * * * *